United States Patent [19]

Ward et al.

[11] 4,317,068

[45] Feb. 23, 1982

[54] PLASMA JET IGNITION SYSTEM

[75] Inventors: Michael A. V. Ward, Lexington; Tai T. Wu, Cambridge, both of Mass.

[73] Assignee: Combustion Electromagnetics, Inc., Arlington, Mass.

[21] Appl. No.: 80,690

[22] Filed: Oct. 1, 1979

[51] Int. Cl.[3] ..... H05B 37/02; H05B 39/04; H05B 41/36

[52] U.S. Cl. ..... 315/209 CD; 123/169 MG; 123/654; 123/627; 315/172; 315/173; 315/209 T

[58] Field of Search ..... 315/171, 172, 173, 209 CD, 315/209 T, 121, 123; 313/123, 139, 140; 123/621, 627, 144, 169 MG, 654

[56] References Cited

U.S. PATENT DOCUMENTS

| | | | |
|---|---|---|---|
| 2,227,714 | 1/1941 | Holthouse et al. | 315/221 |
| 2,457,973 | 1/1949 | Blau | 313/123 X |
| 2,901,672 | 8/1959 | Lauer | 315/172 X |
| 3,440,490 | 4/1969 | Parish | 315/171 X |
| 3,842,818 | 10/1974 | Cowell et al. | 313/139 |
| 3,842,819 | 10/1974 | Atkins et al. | 313/139 |
| 3,956,664 | 5/1976 | Rado et al. | 313/140 |
| 4,071,800 | 1/1978 | Atkins | 313/123 |
| 4,122,816 | 10/1978 | Fitzgerald et al. | 315/209 CD |

*Primary Examiner*—Saxfield Chatmon, Jr.
*Attorney, Agent, or Firm*—Schiller & Pandiscio

[57] ABSTRACT

An improvement on conventional internal combustion ignition systems, which improvement comprises a capacitor connected parallel to the secondary winding of the ignition transformer, and a bypass circuit through which energy stored in the primary circuit is conveyed around the high impedance secondary winding of the circuit transformer to the spark plug after the high voltage at the secondary winding has fired an auxiliary gap to complete the by-pass circuit. The energy originally stored in the primary circuit is discharged at the plug to produce a plasma jet ignition plume.

10 Claims, 6 Drawing Figures

PLASMA JET IGNITION SYSTEM

This invention relates to improvements in systems for igniting a fuel mixture particularly in internal combustion engines.

The need to produce better and more reliable ignition for internal combustion engines has grown hand-in-hand with the need to achieve improved automobile fuel economy and generation of lower amounts of exhaust pollutants. While both conventional and electronic (including capacitive discharge) ignition systems produce reasonably satisfactory ignition of the fuel mixture at stoichiometric air-fuel ratios and normal ambient temperatures, serious problems exist in igniting lean mixtures, wet, cold mixtures, and mixtures containing synthetic fuels such as alcohol.

Conventional ignition systems produce a spark between two electrodes, typically about 1 mm long with a radius of about 0.2 to 0.4 mm. This spark represents a highly localized, high energy density region in which the atmosphere is completely ionized. However, by the very nature of its size, it ignites a very small volume of fuel. The igniting region provided by the spark is limited to its surface where intermediary molecular states exist. Since ignition involves the setting up of a sufficient concentration of suitably active molecules and an insufficient or excessive degree of activation is wasteful from the point of view of causing ignition, such conventional sparks are a wasteful or insufficient source of ignition.

All existing ignition systems, including such esoteric systems as high frequency multi-pulse capacitive discharge systems, (hereinafter referred to as CD systems) produce such conventional ignition sparks and they all use the secondary winding of the ignition coil as the spark generator. Because the coil represents a high impedance generator while the spark is a low impedance load, only a small fraction of the total stored energy can be transferred to the spark, typically only 20–30 millijoules.

Additionally, the oscillation frequency of a conventional spark is about 1 khz, although it is known that optimum ignition occurs at an oscillation frequency, for a 1 mm gap, at about 20 khz. Cf. "Ignition of Gases by Two Successive Sparks With Reference to Frequency Effect of Capacitance Sparks", Kono et al, Combustion and Flame, 27, 85–98 (1976).

It has been recognized that improved ignition can be obtained by providing a plasma jet as distinguished from a conventional spark. Among typical prior art patents teaching production of such a plasma jet are U.S. Pat. Nos. 3,842,818; 3,842,819; and 4,122,816. In all of these patents however, the plasma jet is produced using two electrical energy sources and a complex systems not readily compatible with current ignition systems commercially used.

A principle object of the present invention is therefore to provide an improved system for igniting the fuel-air mixture in a combustion chamber using a plasma jet. Such plasma jet essentially increases the size of the ignition region, and distributes the electrical energy over a larger volume. Additionally, an object of the present invention is to provide such a plasma jet wherein the total energy content is increased over the prior art conventional sparks without excessive modification of a conventional ignition system and without the introduction of additional generators of electrical energy or additional complexity to the ignition system. Yet another object of the present invention is to provide an ignition system employing a plasma jet in a circuit which is self resonant with the frequency in the 5–30 khz range, and has a very small source impedance.

To effect the foregoing objects, the system of the present invention includes the usual transformer and means for coupling the primary winding of the latter to a standard electrical energy source such as a CD or standard twelve or twenty-four volt ignition system, the secondary winding of the transformer being connectable to a main spark gap such as a spark plug. The invention particularly includes a capacitor connected in parallel to the secondary winding and a by-pass circuit connecting, in series from the high voltage side of the primary winding to the high voltage side of the secondary winding, an inductor and an auxiliary spark gap. The parameters of the by-pass circuit and the capacitor are chosen, as will be described hereinafter, with respect to the parameters of the rest of the system, such that upon discharge of energy through the transformer sufficient to cause breakdown across the main spark gap, the auxiliary spark gap must break down prior to breakdown of the main gap. The result is a substantial high energy plasma jet or plume.

In a particular embodiment, the auxiliary gap is incorporated in the spark plug tip so that the discharge across the auxiliary gap can also be used for ignition and so that it can be exposed to the same environment as the main spark gap, thereby improving the characteristics of the plume.

Other objects of the present invention will in part be obvious and will in part appear hereinafter. The invention accordingly comprises the processes involving the several steps and the relation and order of one or more of such steps with respect to each of the others, which are exemplified in the following detailed disclosure and the scope of the application all of which will be indicated in the claims.

For a fuller understanding of the nature and objects of the present invention, reference should be had to the following detailed description taken in connection with the accompanying drawings wherein like numerals denote like parts, and;

Figure 1:
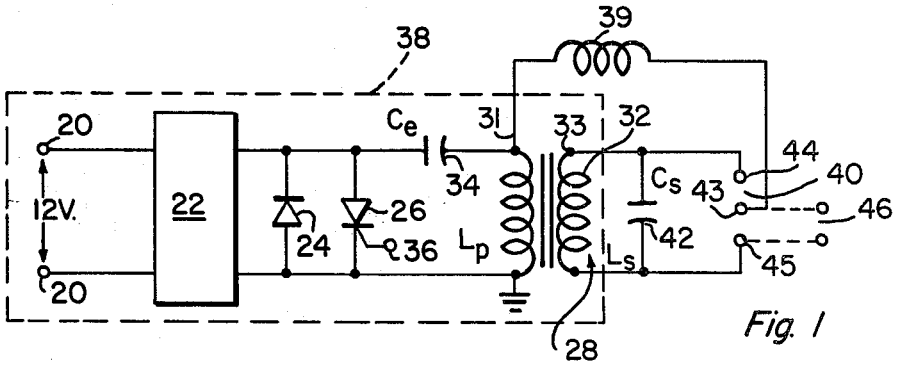
FIG. 1 is a circuit schematic, partly in block diagram incorporating the principles of the present invention.

Referring now to FIG. 1 there is shown an ignition system including a pair of input terminals 20 to which a DC source may be applied, typically of 24 or 12 volts. Terminals 20 in turn are connected to DC-to-AC converter 22, the output of the latter in turn being connected to diode 24 and silicon controlled rectifier (SCR) 26. Diode 24 and SCR 26 are connected in parallel to one another across the output of converter 22 with diode 24 connected in opposite polarity to SCR 26. The circuit of FIG. 1 also includes transformer 28 having a primary winding 30 and secondary winding 32 corresponding ends of windings 30 and 32 being connected to ground. The grounded end of the primary winding 30 is connected to one output terminal of converter 22, the other or high voltage end of primary winding 30 is connected to the other output terminal of converter 22 through capacitor 34. SCR 26 is provided with the usual gate electrode 36, to which timing pulses, for example from distributor points, are intended to be applied.

It will be recognized immediately that transformer 28 is simply a conventional spark coil and in connection with all of the components thus described and shown in the block delineated by dashed line 38, constitute a typical form of a prior art CD type of ignition system. Typically capacitor 34 is a medium voltage (400–1200 V) energy storage capacitor.

The embodiment shown in FIG. 1 also includes a by-pass circuit connecting high voltage end 31 of primary winding 30 to high voltage end 33 of secondary winding 32 along a path which runs in a series from primary winding 30 through by-pass inductor 39 and thence a pair of spaced terminals 43 and 44 which define auxiliary spark gap 40. Additionally, time delay capacitor 42 is connected across secondary winding 32, capacitor 42 also being in parallel with terminals 44 and 45 (respectively connected to high and low voltage taps on secondary winding 32). Terminals 43 and 45 constitute means for coupling secondary winding 32 to a main spark gap, shown at 46, such as that of conventional spark plug or the like.

The operation of the circuit of FIG. 1 is advantageously described in connection with a number of selected parameters. For example, one can assume a 12 volt input to converter 22, the latter in turn being a 200 watt, 12 volt dc to 650 volt ac transistor converter circuit which requires about five msec. to charge capacitor 34. Where the capacitance of the latter is typically 5 μf, the 5 msec. charge by converter 22 during the time and distributor points are closed will introduce about 1 joule into capacitor 34. When the points connected to terminal 36 open, SCR 26 is triggered so that the potential at high side 31 of primary winding 30 rises to about 600 volts in 10 to 30 μsec. Simultaneously, through the mutual inductance of transformer 28, high voltage side 33 of secondary winding 32 rises to a value of about 20 kv, charging capacitor 42 and whatever cable stray capacitance is in the circuit. Now if for example, gap 40 is about 0.050 inches across and the atmosphere in gap 40 is at a pressure of about six atmospheres, at this value of 20 kv, the dielectric in gap 40 will break down and a discharge across the gap will occur. Since this discharge, for all practical purposes, constitutes a short circuit across gap 40, the voltage across terminals 43 and 45 will now also rise to the potential of about 20 kv.

Now for a given pressure, the voltage required to breakdown a gap as a function of time is defined by Gould and Roberts, *Journal of Applied Physics*, Vol. 27, No. 10, 1167 (1956). For example, for a breakdown time of 0.020 μsec. at an 0.02 inch gap and a pressure of six atmospheres, a voltage greater than 9.2 kv is required. The voltage between terminals 43 and 45 (i.e. across gap 46) will decay according the the equation:

$$V_s = V_0 \cos \omega t \qquad (1)$$

where: $V_0$ is the voltage between terminals 43 and 45 immediately following breakdown across gap 40; and $\omega$ is $1/\sqrt{LC}$ where L is the inductance of by-pass inductor 39 and C is the capacitance of capacitor 42.

Taking typical values where L is 40 μH and C is 100 pf, then $$\omega = 16 \cdot 10^6 \qquad (2)$$

and from equation (1)

$$V_s = V_0 \cos 16t \qquad (3)$$

where t is in microseconds.

If t equals 0.02 μsec, then $$(3)\ V_s = 0.95\ V_0$$

and it is clear that a discharge to occur in a spark plug gap 46 of about 0.02 inches connected across terminals 43 and 45, $V_0$ must be greater than 10 kv.

To summarize, the overvoltage at the instant of breakdown of gap 40 must be sufficiently high such that the breakdown of main spark gap 46 connected to terminals 43 and 46 occurs prior to sufficient voltage decaying through inductor 39 and capacitor 42 to prevent the latter breakdown. The size of the main spark gap connected to terminals 43 and 45 and the values of capacitors 42 and inductor 39 must be chosen to give the required overvoltage. It has been found that the conditions typically are satisfied when gap 40 is 0.05 inches, terminal 43 and 45 are connected to a main spark gap 46 of 0.025 to 0.03 inches, C=100 pf and L=40 μH.

There are other conditions which should be met, namely that the energy stored in capacitor 34 be about 1 joule, that the resonant frequency of the discharge across the main spark gap 46 be in the range of about 5 to 30 KHz, and that the square root of the ratio of the by-pass inductor 39 to capacitor 34 be as small as practicable, preferably less than approximately 3 ohms. The values for the circuit parameter given above satisfy these latter conditions as well.

It should be noted that at the moment the voltage has broken down the atmosphere in main spark gap 46, capacitor 34 which is charged in the example given to about 650 volts sees a path to ground through by-pass inductance 39 and the low impedance path provided by the discharge across gap 46. Consequently, capacitor 34 dumps its energy through by-pass inductor 39 and into the gap creating a plasma jet in gap 46. This path of course is preferable to the parallel path through primary winding 30 or the alternate path to ground through secondary winding 32 and the discharge in gap 40, since the inductance of either transformer winding is much greater than that of inductor 39. Typically, for example the inductance of primary winding 30 will be in the order of 8 mH where the inductance of the by-pass inductor is in the neighborhood of 20–40 μH i.e. the ratio of the inductances of the by-pass to primary windings is about 1/200 to 1/400.

The oscillation frequency f of the plasma plume in gap 46 is given by $$f = 1/(2p\sqrt{LC})$$

where L is the value of inductance of by-pass inductor 39 and C is the capacitance of capacitor 34.

Using the circuit values given above it will be appreciated then that f is about 11 KH which is in the desirable range for optimal ignition.

After one complete cycle, SCR 26 will shut off, most of the energy in capacitor 34 having by then been dissipated in the plasma jet or plume formed across gap 46. Since the inductance of the primary winding 30 is much greater than that of by-pass inductor 39, the shut-off of SCR 26 will be completed prior to the time that any material amount of energy from capacitor 34 will have significantly decayed through the oscillatory circuit provided by capacitor 34 and primary winding 30. It may however be desirable to add additional inductance to primary winding 30 uncoupled to secndary winding 32, in order to reduce the rate of decay of the voltage at point 31 through the primary winding. Such additional inductance would also reduce the energy coupled through the transformer action to the secondary winding 32 and increase the energy stored in primary winding 30, where applicable.

During the stage where capacitor 34 discharges to create the plasma jet, the current will be limited by the source impedance of capacitor 34 and by-pass inductor 39. This source impedance should be preferably less than about 3 ohms. It will be seen that by using the proposal values whereby the inductance of by-pass inductor 39 is 40 $\mu$H and the capacitance of capacitor 34 is 5 $\mu$f, a source impedance is found of about 2.8 ohms which is less than the maximum value of 3Ω. Reducing the inductance of inductor 39 to 20 $\mu$H and increasing the capacitance of capacitor 34 to 8 $\mu$f reduces the source impedance to the more desirable value of 2Ω. After SCR 26 has shut off, capacitor 34 is recharged by converter 22 to become ready for firing when the points open.

Figure 2:
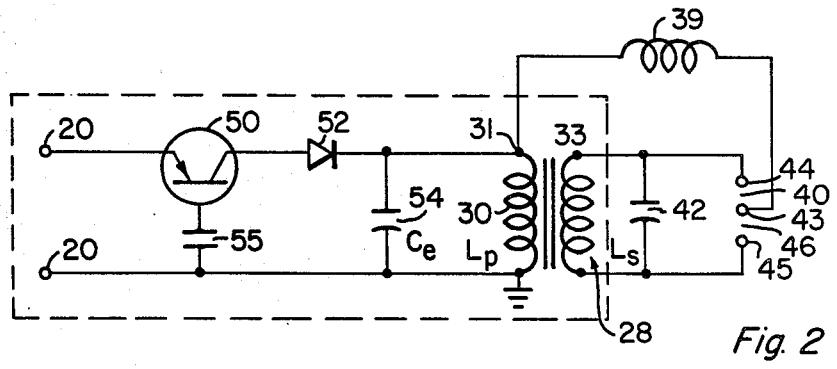
FIG. 2 is a circuit diagram of an alternative version of the circuit of FIG. 1 incorporating the principles of the present invention.

Besides using the CD system of FIG. 1 in the circuit of the invention to create the plasma plume, a standard electronic 12-volt ignition system with transistor switch replacing the points can also be used as is shown in FIG. 2. In FIG. 2, transistor 50 has its emitter connected to one of terminals 20, the collector of transistor 50 being connected to the anode of diode 52. The cathode of the latter is connected to high voltage end 31 of primary winding 30 of transformer 28. Capacitor 54 is connected in parallel to winding 30. Points or contacts 55 are provided for connecting and disconnecting the base of transistor 20 to ground. Transformer 28 includes secondary winding 32, the high voltage end 33 of the latter being connected to terminal 44, the other end being connected to terminal 45. As in FIG. 1, by-pass inductor 39 is connected at one end to end 31 of winding 30 and the other end of inductor 39 is connected to terminal 43. The latter is disposed between terminals 44 and 45 so that the space between terminal 43 and terminal 44 then constitutes gap 40 and space between terminal 43 and terminal 45 constitutes gap 46. Lastly, capacitor 42 is connected in parallel to winding 32.

The system shown in FIG. 2 is simpler and less expensive than that of FIG. 1, but suffers from the usual limitations of electronic ignition versus CD ignition. In the CD system of FIG. 1, energy storage occurs very rapidly (and is only limited by the power capacity of converter 22) and the energy is stored at the required voltage (e.g., 650 v) to create the plasma plume. Thus, when the points close, capacitor 34 becomes completely charged (to 650 v) and discharges when the points open. On the other hand, electronic ignition as exemplified in FIG. 2 operates so that energy is stored in the primary winding 30 by current build-up which is initiated when points 55 close. Thus, in FIG. 2, for a suitable transformer 28 in which typically primary inductance $L_p$ is about 3 mH and primary resistance $r_p$ is about 0.5Ω, the time constant T for energy build-up is $L_p/r_p$ or 6 msec.

Three of these time constants are required for 90 percent energy build-up. A reduction of $L_p$ in order to decrease T reduces the stored energy, so that one has to compromise. The system with the above values can be used for single-cylinder engines such as outboard motors, motorcycle engines, and four-cylinder engines operating between 600 and 3,000 rpm. A more practical approach is to raise the supply voltage (to 18 v or 24 v) and thus increase the stored energy without changing $L_p$ or $r_p$.

Returning to the operation of the electronic system of FIG. 2, it is noted that energy builds up in transformer 28 when points 55 are closed (dwell time). When points 55 open, the current is interrupted and an inductive voltage is created across the primary winding 30 due to the inductive kick. The circuit of FIG. 2 is based on the realization that by placing appropriate capacitores 54 and 42 across the primary and secondary windings 30 and 32, respectively, the energy stored in the primary winding is transferred and stored in capacitor 54 in a time given by:

$$t_{storage} = \frac{\pi}{2}\sqrt{L_p \cdot C_e}$$

The voltage to which capacitor 42 is charged is given by:

$$V_A = \sqrt{\frac{L_p}{C_e}} \cdot I_p$$

where $I_p$=current in the primary circuit prior to points opening (which is within 10 percent of the maximum value $I_{pmax}$ after t=3 T and the system can be so designed that $V_A \simeq 650$ volts (or other desirable value).

Thus, as in operation of the circuit of FIG. 1, a plasma jet in gap 46 results (assuming the conditions discussed earlier with reference to FIG. 1 for plasma jet creation are also satisfied).

Figure 3:
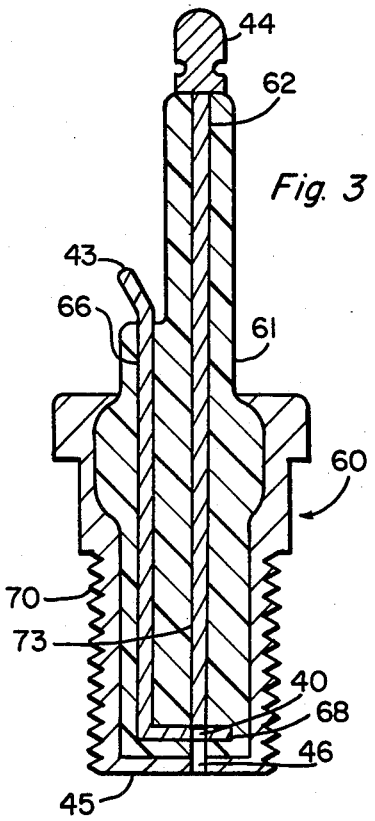
FIG. 3 is an idealized cross-section diagram through the body of a novel spark plug incorporating the auxiliary and main spark gaps of the present invention.

In FIG. 3 there is shown a spark plug configuration useful in connection with the present invention in that the auxiliary gap and the main spark gap are both located in the vicinity of the plug tip so that the entire energy of both discharges can be used for ignition. Plug 60 is formed of the usual elongated ceramic body 61 having an elongated metallic electrode 62 substantially centrally disposed therein. One end of electrode 62 is connected externally to terminal 44, the other end 63 terminating within a coaxial bore 64 provided in the opposite end of plug 60. A second elongated electrode 66 is also disposed within the body of plug 60, extending substantially for most of its length parallel to electrode 62. One end of electrode 66 adjacent terminal 44 is connectable to terminal 43 as shown in FIG. 2. The other end 68 of electrode 66 is in the form of ring circumferentially disposed around bore 64 intermediate the ends of the latter and spaced from end 63 of electrode 62. It will be apparent than that the spacing between end 68 and end 63 constitutes auxiliary spark gap 40. The base portion of plug 60 is covered with a metallic coat or layer 70 so that the bottom end of the plug (which is centrally apertured by bore 64) constitutes terminal 45. Of course, electrodes 66, 62 and layer 70 are all electrically insulated from one another by ceramic body 61 and layer 70 is intended to be grounded when the plug is inserted into an engine. Because end 45 is physically and electrically separated from ring 68, the interspace therebetween will be seen to constitute gap 46. Gap 40 is preferably about 0.050 inches and gap 46 is about 0.025 to 0.030 inches for a total stored energy of about 1 to 2 joules in the system. With this arrangement, a 400 to 600 volt potential will not by itself fire gap 46.

Figure 4:
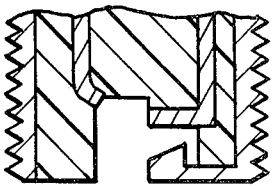
FIG. 4 is a cross-section through an idealized spark plug which is an alternative version to that of FIG. 3.
Figure 5:
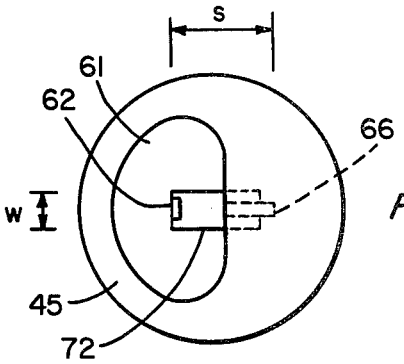
FIG. 5 is a bottom plan view of the spark plug of FIG. 4.

An alternative plug structure, is shown partially in FIGS. 4 and 5. Ordinarily, for a short arc characteristic of a spark plug (i.e. less than 2 mm long) drawing a current of about 60 amps and the voltage drop along the arc (i.e. anode to cathode) is about 30 volts representing 1.8 KW power absorption by the arc. Reducing the source impedance below 2 is difficult, hence the plug of FIG. 4 is designed to increase the voltage drop of the arc thus maximizing the power (KW) of the arc discharge. Arc voltage drop is increased by providing means for rapidly moving or translating the position of the arc about its normal straight path between anode and cathode. Additionally, by confining the arc discharge to a slot with a width W less than 10 mm, the arc voltage drop can be increased. This increase reaches a maximum value of about double for $W \simeq 1$ mm, primarily due to cooling of the arc by the slot walls. Also confinement of the arc to a slot, optimally about 1 mm wide, tends to increase the arc velocity thereby increasing the arc voltage drop. For example, the voltage gradient for a 100 ampere stationary short arc will increase, upon confinement of the arc to a 1 mm slot, from about 10 v/cm to about 60 v/cm.

The foregoing consideration is exemplified by the structure shown in FIGS. 4 and 5 wherein the bottom surface of plug 60 is provided with the slot 72 having a width W of preferably from 0.04 to 0.08 inches, preferably 0.06 inches. The slot has a length S from about 0.05 to about 0.1 inches, preferably about 0.75 inches. Slot 72 is also preferably quite shallow, the depth being sufficient to accomodate the following described electrode structure. As in FIG. 3, the plug is formed of a ceramic body 61, the bottom of which is covered in part by an electrically conductive layer which constitutes terminal 45, part 74 of the latter overlying a portion of the length of slot 72 and directed at a slight upward angle into the slot. End 68 of electrode 66 is disposed horizontally along the top, i.e. deepest portion of slot 72. The maximum separation between part 74 and end 68 is preferably about 0.05 inches while the distance between the closest portions of the electrodes is preferably about 0.025 to 0.03 inches inasmuch as this latter separation between electrode 45 and 68 will be seen to constitute gap 46. Part 74 and end 68 are approximately parallel, i.e. they approach each other as shown at an angle lying somewhere between 0° and 45° so as to define an inter-electrode space 76 terminating at one end in the ceramic of body 61 and at the other end as gap 46. Disposed at the opposite end of slot 72 is termination 63 of electrode 62, end 63 being displaced from end 68 by about 0.05 inches inasmuch as this latter separation constitutes gap 40.

With reference to the plugs of both FIGS. 3, and 4, the sequence of events in operation is as follows:

When the ignition points open, the potential between electrodes 62 and 66 rise to around 20 kv voltage and therefore break down the gaseous dielectric in the wider gap 40. Before the voltage can decay substantially through inductor 39, the voltage then breaks down the gaseous dielectric in gap 46. Capacitor 34 (or 54 as the case may be) which is typically charged at around 400 to 1,200 volts, now sees a low impedance path to ground through inductor 39 and the arc in gap 46, and dumps its energy into the arc. The arc is blown apart (drawing 20 to 200 amps of current for about 100 μsec) as a result of the pressure build-up created by the energy dissipated within the arc. The resulting bursted arc blasts out of the bore 64 (or slot 72) in the form of an ionized plasma plume, typically 1–2 cm in length and $\frac{1}{4}$–$\frac{1}{2}$ cm in diameter.

In the embodiment of FIGS. 4 and 5, it will be recognized that the approximate parallelism between part 74 of terminal 45 and end 68 of electrode 66 defines a pair of rails, so that when an arc is struck across them, the arc, being subjected to a strong magnetic field, tends to be moved out of gap 46 and into the remainder of slot 72. This motion of the arc, together with the confinement of the latter to slot 72, tends as noted to increase substantially the voltage drop of the arc.

Figure 6:
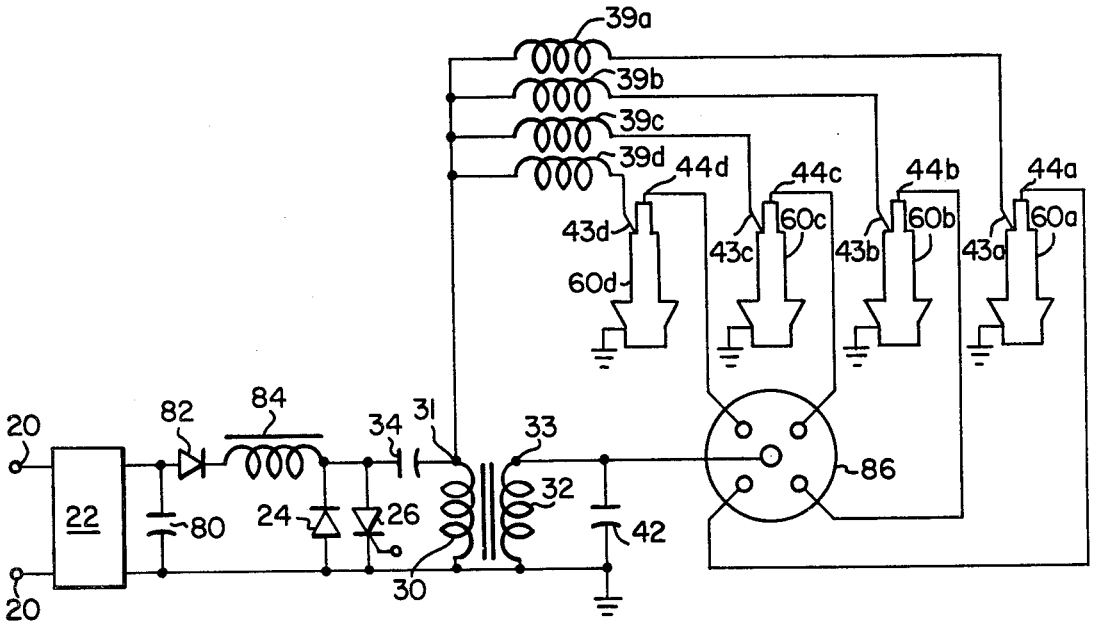
FIG. 6 is a schematic drawing showing the present invention applied to a multicylinder engine.

In FIG. 6 there is illustrated a typical application of the invention to a four cylinder engine, in which CD system for example as shown in FIG. 1, is used as the preferred method of storing the ignition energy. As shown however, the device further includes storage capacitor 80, preferably an electrolytic capacitor of 16 μf and 700 WVDC, shunted across the output of converter 22. In series between the high side of the output of converter 22 and capacitor 34, there are diode 82 and choke inductor 84. Capacitor 80 serves to provide a more constant load for converter 22 than the circuit shown in FIG. 1 and provides for rapid recharging of capacitor 34 typically in 2 msec or less. This permits one to fire SCR 26 within about 1 to 2 msec after the first firing, thereby to create a second arc assisting the initial burn. Inductor 84 isolates capacitor 80 from the rapid events occurring during firing of the spark plug. The value of inductor 84 (typically about 100 mH) should be low enough so that the flow of power from converter 22 (e.g. 180 watts at 2 KHz) is not limited, but high enough so that its discharge time constant is long relative to the time constant of the plasma plume. Diode 82 prevents oscillations between capacitor 80 and the remainder of the circuit shown to its right.

Terminal 31, on the high voltage side of the primary winding of the transformer in CD system block 38 is connected through respective parallel inductors **39*a*, 39*b*, 39*c* and 39*d* to corresponding input electrodes 43*a*, 43*b*, 43*c* and 43*d* of respective spark plugs 60*a*, 60*b*, 60*c* and 60*d* of the type typically shown in FIG. 3. The provision of separate inductors, one for each of the spark plugs, serves to isolate or buffer the plugs from one another during operation. Alternatively, a single inductor may be used with a distributor modified to provide double contacts. The high voltage end 33 of the transformer in CD system block 38 is coupled to the center tap of distributor 86. The latter may be the usual mechanical distributor with a rotating armature, or an electronic commutature or the like, all well known in the art. The respective output taps of distributor 86 which are sequentially energized by the operation of the distributor, are connected to terminals 44*a*, 44*b*, 44*c* and 44*d* of plugs 60*a*, 60*b*, 60*c* and 60*d***.

It should be noted that the high voltage of the transformer secondary winding is imposed on each spark plug sequentially by operation of distributor 86, although the high voltage of the primary winding is connected to all of the spark plugs simultaneously. When one engine cylinder is under compression and about to fire, one or more of the others is in an intake or exhaust portion of its cycle, with a cylinder pressure around or even less than one atmosphere. It is imperative then that the main spark gap 46 on each of plugs 60*a*, 60*b*, 60*c* and 60*d* not be so small that the voltage level at the high end of the primary winding can fire the plug when the pressure of the gaseous dielectric in gap 46 is thus low. Typically, for a main spark gap of around 0.025 inches, firing will not occur even at a primary voltages as high as 600 volts for properly disposed electrodes 43 and 45.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In an electrical ignition system including a transformer, means for coupling an electrical energy source to the primary winding of said transformer, and means for coupling the secondary winding of said transformer across the electrodes of a main ignition spark gap, the improvement comprising:

an output capacitor connected in parallel to said secondary winding; and a by-pass circuit including, in series connection from a high voltage portion of said primary winding to a high voltage portion of said secondary winding, an inductor and an auxiliary spark gap one of the electrodes of which constitutes a corresponding one of the electrodes of the main ignition spark gap, the parameters of said circuit and said output capacitor being chosen with respect to the parameters of said system such that upon discharge of energy from said source through said transformer sufficient to cause dielectric breakdown across said main spark gap, said auxiliary gap must breakdown prior to breakdown of said main gap.

2. A system as set forth in claim 1 wherein said auxiliary spark gap comprises a spaced-apart pair of terminals, one terminal connected to said inductor and the other terminal connected to said high voltage portion of said secondary winding, said means for coupling said secondary winding to said main spark gap comprising said other terminal and a third terminal connected to system ground.

3. A system as set forth in claim 1 wherein said other terminal is positioned between said one terminal and said third terminal, said terminals being electrically insulated from one another and separated by gaseous dielectrics.

4. A system as set forth in claim 1 including means for establishing that the resonant frequency of said by-pass circuit including said main spark gap is in the range of about 5 to 30 KHz.

5. A system as set forth in claim 1 including an input capacitor coupled to said primary winding for storing electrical energy.

6. A system as set forth in claim 5 wherein the source impedance, defined as the square root of the ratio of the inductance of said inductor to the capacitance of said capacitor, is not substantially greater than 3 ohms.

7. A system as set forth in claim 1 including means for maximizing the discharge power across said main spark gap.

8. A system as set forth in claim 1 wherein said auxiliary and main spark gaps are disposed to be positioned in a common atmosphere, and said main spark gap is shorter than said auxiliary gap.

9. A system as set forth in claim 7 wherein said main gap is about 0.025 inches and said auxiliary gap is about 0.05 inches.

10. A system as set forth in claim 1 including a plurality of separate main spark gaps, said by-pass circuit comprising a like plurality of parallel circuits each including an inductor and spark gap connected in series from said high voltage portion of said primary winding to respective first terminals of said gaps, and a distributor connected for commutating the high voltage of said secondary winding in sequence to respective opposite terminals of said gaps.

* * * * *